US005687623A

United States Patent [19]

Hsieh

[11] Patent Number: 5,687,623

[45] Date of Patent: Nov. 18, 1997

[54] REVERSIBLE SOCKET WRENCH

[76] Inventor: Chih-Ching Hsieh, No. 64, Lane 107, Liang Tsun Rd., Fong Yuan City, Taichung Hsien, Taiwan

[21] Appl. No.: 681,349

[22] Filed: Jul. 23, 1996

[51] Int. Cl.[6] ..... B25B 13/46

[52] U.S. Cl. ..... 81/60; 81/63.1

[58] Field of Search ..... 81/60, 61, 62, 81/63.1, 63, 63.2, 59.1

[56] References Cited

U.S. PATENT DOCUMENTS

| | | | |
|---|---|---|---|
| 1,050,583 | 1/1913 | Whitney | 81/59.1 |
| 1,510,059 | 9/1924 | Holle | 81/62 |
| 3,191,466 | 6/1965 | Kawashima | 81/62 |
| 3,436,992 | 4/1969 | Over et al. | 81/63.1 |
| 4,445,404 | 5/1984 | Parker | 81/62 |
| 5,531,139 | 7/1996 | Fanchang et al. | 81/63.1 |

FOREIGN PATENT DOCUMENTS

| | | | |
|---|---|---|---|
| 244777 | 12/1925 | United Kingdom | 81/60 |

*Primary Examiner*—D. S. Meislin
*Assistant Examiner*—Joni B. Danganan
*Attorney, Agent, or Firm*—Varndell Legal Group

[57] ABSTRACT

A reversible socket wrench including a socket having two radial through holes and an outside annular groove around the periphery, two locating devices respectively mounted in the radial through holes, a clamp mounted in the outside annular groove and moved between two positions to alternatively force the locating devices into the operative position, and a handle having a driving rod at one end inserted into the socket, wherein when the driving rod of the handle is turned in one direction, the locating device which is set in the operative position is forced into engagement with the driving rod, for permitting the socket to be turned with the driving rod, or disengaged from the driving rod, for permitting the driving rod to run idle.

3 Claims, 5 Drawing Sheets

REVERSIBLE SOCKET WRENCH

BACKGROUND AND SUMMARY OF THE INVENTION

The present invention relates to socket wrenches, and relates more particularly to a reversible socket wrench which can be for forward turning or backward turning alternatively.

A variety of socket wrenches have been disclosed for use with a socket to turn bolts, nuts, etc., and have appeared on the market. These socket wrenches are commonly not reversible. When the socket is turned forwards through one step, the socket wrench must be removed from the socket and then mounted on it again so that the socket can be turned forwards again. Because these socket wrenches are not reversible, much time will be wasted in the loading and unloading of the device.

The present invention has been accomplished to provide a socket wrench which is reversible. According to the present invention, the reversible socket wrench comprises a socket having two radial through holes and an outside annular groove around the periphery, two locating devices respectively mounted in the radial through holes, a clamp mounted in the outside annular groove and moved between two positions to alternatively force the locating devices into the operative position, and a handle having a driving rod at one end inserted into the socket, wherein when the driving rod of the handle is turned in one direction, the locating device which is set in the operative position is forced into engagement with the driving rod, for permitting the socket to be turned with the driving rod, or disengaged from the driving rod, for permitting the driving rod to run idle.

DETAILED DESCRIPTION OF THE PREFERRED EMBODIMENT

Figure 1:
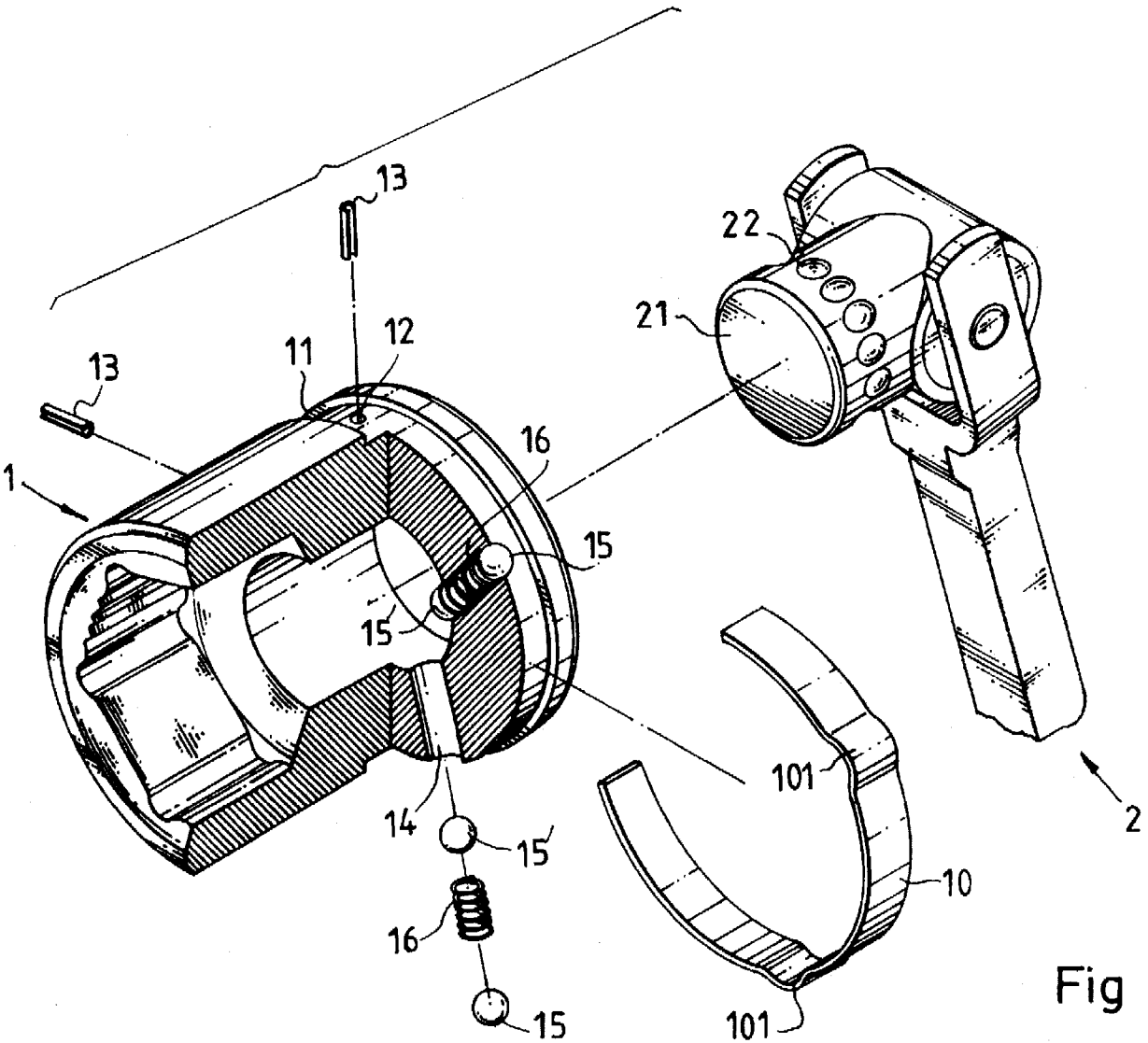
FIG. 1 is an exploded view of a reversible socket wrench according to one embodiment of the present invention.
Figure 2:
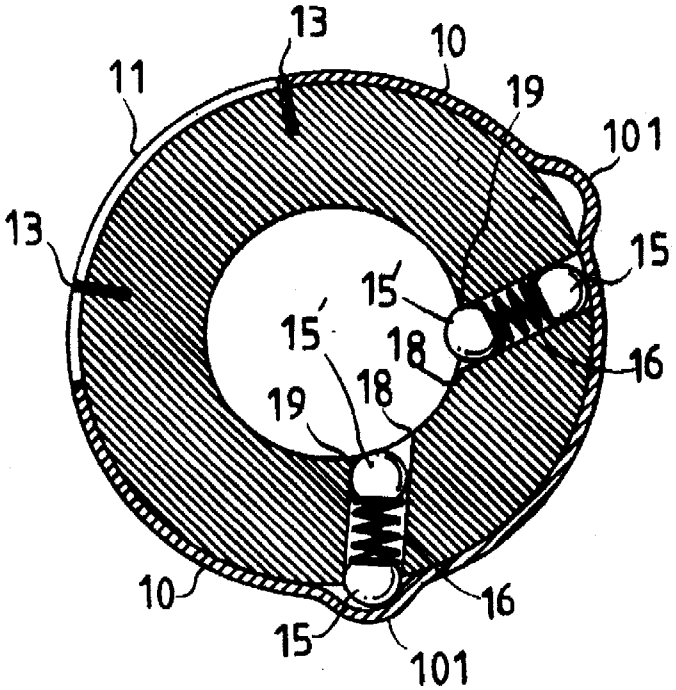
FIG. 2 is a cross sectional view of the reversible socket wrench shown in FIG. 1 before the installation of the handle.
Figure 3:
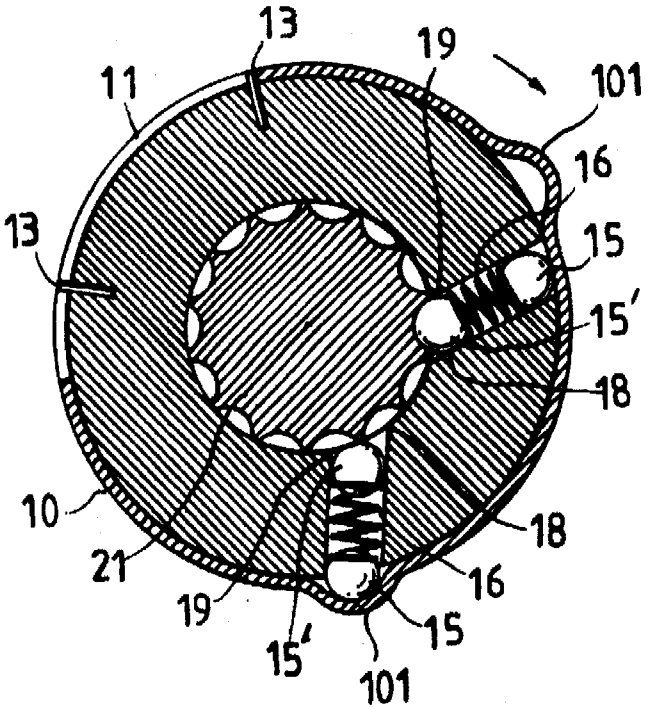
FIG. 3 is a cross sectional view of the reversible socket wrench shown in FIG. 1, showing the driving rod of the handle inserted into the socket and the socket wrench set at the forward driving mode.
Figure 4:
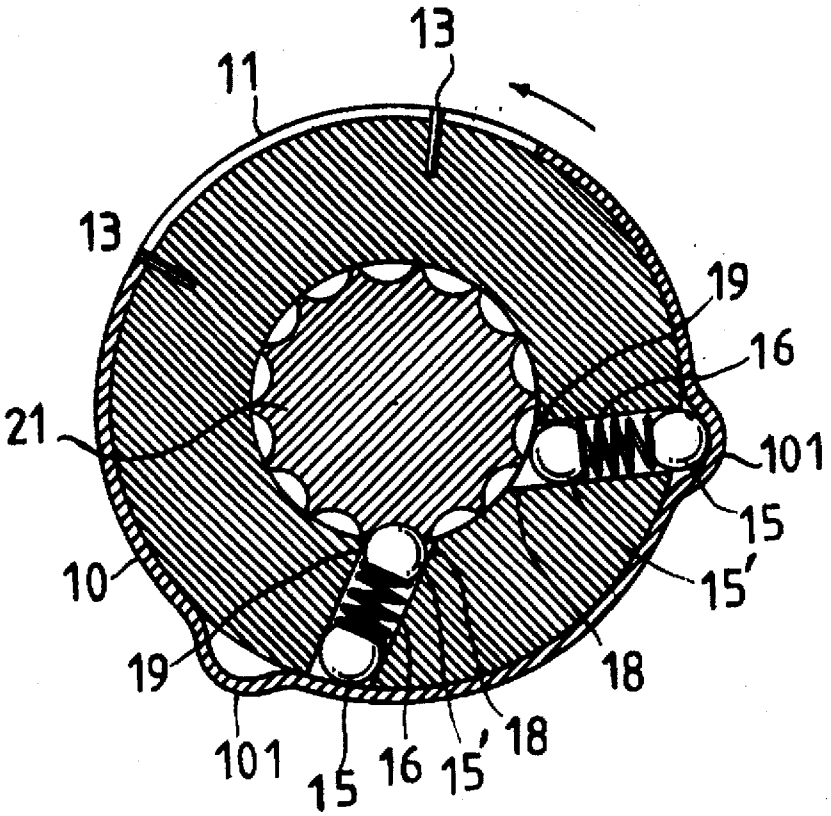
FIG. 4 is another cross sectional view of the reversible socket wrench shown in FIG. 1 when set at the backward driving mode.

Referring to FIGS. 1, 2, 3, and 4, a reversible socket wrench in accordance with the present invention is generally comprised of a socket 1, and a handle 2. The socket 1 comprises an outside annular groove 11, two radial locating holes 12 through the outside annular groove 11, and two radial through holes 14 respectively disposed opposite to the radial locating holes 12. Two spring pins 13 are respectively mounted in the radial locating holes 12 and disposed in flush with the periphery of the socket 1. Two outer steel balls 15 and two inner steel balls 15' are respectively mounted in the through holes 14 at two opposite ends. Two springs 16 are respectively mounted in the through holes 14 and stopped between the outer steel balls 15 and the inner steel balls 15'. A clamp 10 is mounted around the outside annular groove 11 of the socket 1, having two arched portions 101 curving outwards. The clamp 10 can be moved in the outside annular groove 11 of the socket 1 to abut one end against one spring pin 13. The handle 2 has a circular driving rod 21 perpendicularly disposed at one end and adapted for inserting into the socket 1, and a plurality of rounded recesses 22 spaced around the periphery and adpated for receiving one inner steel ball 15'. The two through holes 14 are so made that the inner end of each through hole 14 defines first and second contact portions between the inner steel ball 15' and an edge of the through hole 14. The first contact portion 18 has an axial length that is longer than the radius of the inner steel balls 15', and the second contact portion 19 has an axial length that is shorter than the radius of the inner steel balls 15'. When the inner steel ball 15' is forced into contact with the first contact portion 18, the socket 1 will be turned with the circular driving rod 21; on the contrary, when the inner steel ball 15' is forced into contact with the second contact portion 19, the circular driving rod 21 will run idle. FIG. 3 shows the socket wrench set at the forward driving mode. At this forward driving mode, the socket 1 and the circular driving rod 21 of the handle 2 are positively retained together when the handle 2 is turned clockwise; the socket 1 is disengaged from the circular driving rod 21 of the handle 1 when the handle 2 is turned counter-clockwise. FIG. 4 shows the socket wrench set at the backward driving mode. At this backward driving mode, the socket 1 and the circular driving rod 21 of the handle 2 are positively retained together when the handle 2 is turned counter-clockwise; the socket 1 is disengaged from the circular driving rod 21 of the handle 2 when the handle 2 is turned clockwise.

Figure 5:
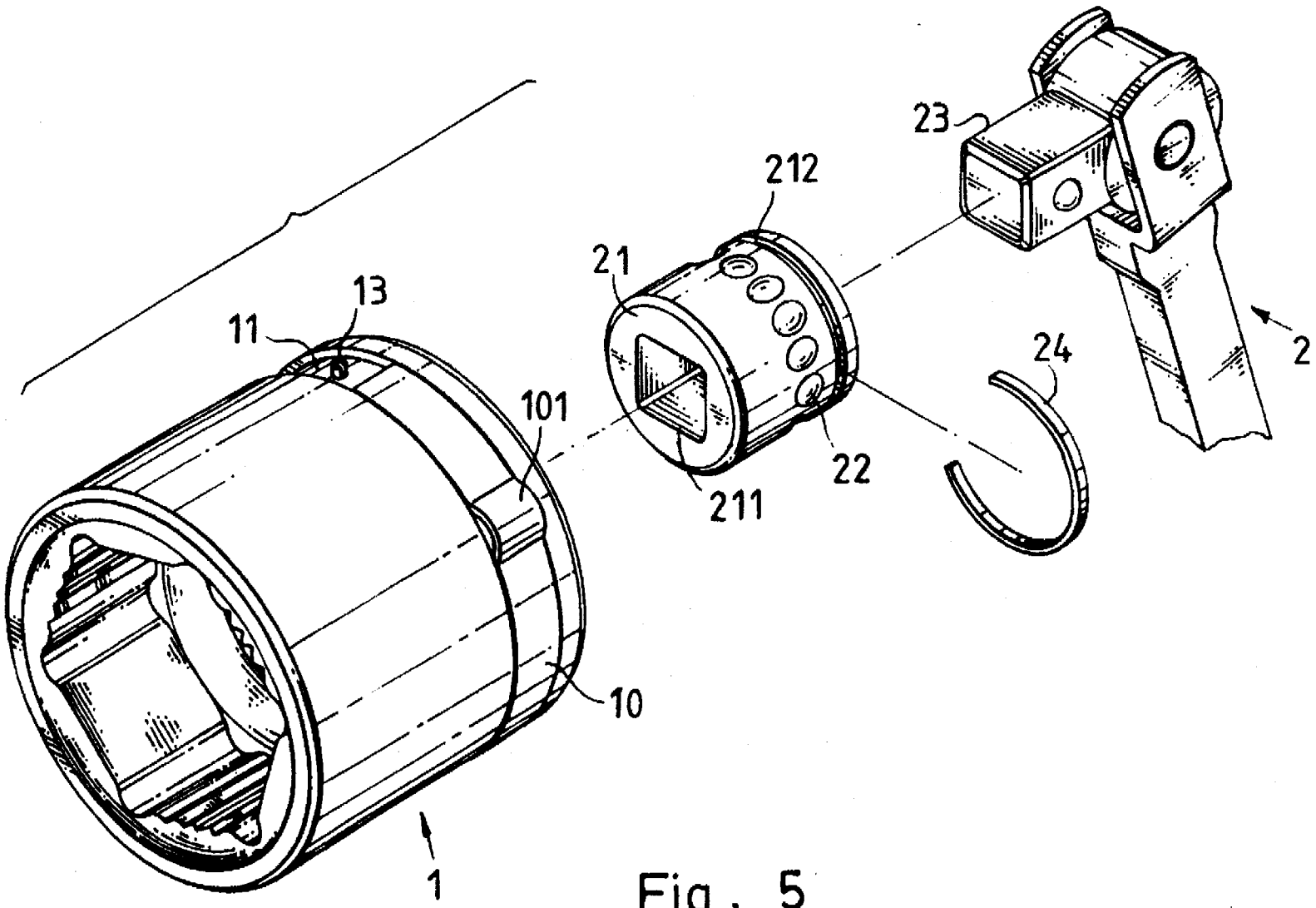
FIG. 5 is an exploded view of a reversible socket wrench according to a second embodiment of the present invention.

FIG. 5 shows an alternate form of the present invention, in which the socket 1 is remained unchanged; the handle 2 comprises a square coupling rod 23 perpendicularly disposed at one end, and a circular driving rod 21 coupled to the square coupling rod 23 and secured in place by a clamp 24. The circular driving rod 21 has a square axial hole 211 which receives the square coupling rod 23, a plurality of rounded recesses 22 spaced around the periphery, and an outside annular groove 212 around the periphery near one end which receives the clamp 24.

Figure 6:
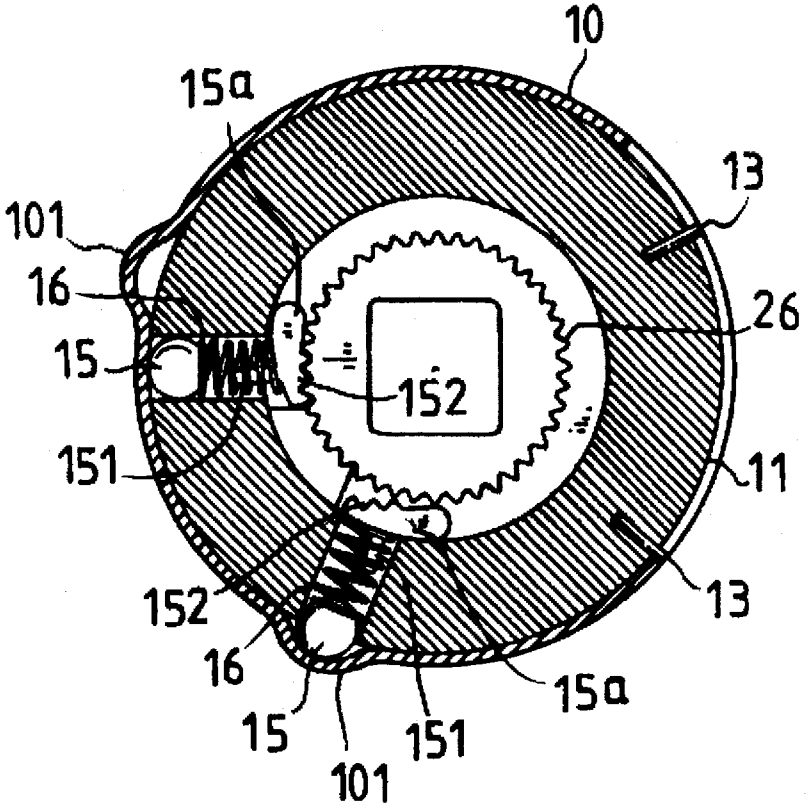
FIG. 6 is a cross sectional view of a reversible socket wrench according to a third embodiment of the present invention.

FIG. 6 shows another alternative form of the present invention, in which the driving rod 21 of the handle 2 has a toothed portion around the periphery, two toothed members 15*a* are respectively mounted in the socket 1 to replace the aforesaid inner steel balls 15'. Each toothed member 15*a* comprises a toothed oval body 152 adapted for engaging the toothed portion of the driving rod 21, and a locating rod 151 perpendicularly raised from the toothed oval body 152 and coupled to the corresponding spring 16. When the outer steel ball 15 is forced inwards by the clamp 10 (that is when the outer steel ball 15 is not in alignment with the corresponding arched portion 101) and the driving rod 21 of the handle 2 is turned in one direction the toothed oval body 152 of the corresponding toothed member 15*a* is forced into engagement with the toothed portion 26 of the driving rod 21, and therefore the socket 1 is turned with the driving rod 21. If the driving rod 21 of the handle 2 is turned in the reversed direction, the toothed oval body 152 of the corresponding toothed member 15*a* will disengage from the toothed portion of the driving rod 21, thereby causing the driving rod 21 to run idle.

I claim:

1. A reversible socket wrench comprising:

a socket having an outside annular groove, two radial locating holes in said outside annular groove, and two through holes respectively disposed opposite to said radial locating holes;

two spring pins respectively mounted in said radial locating holes of said socket and disposed in flush with a periphery of said socket;

two locating devices respectively mounted in said through holes of said socket and alternatively movable between an operative position and a non-operative position, each of said locating devices including an inner steel ball and an outer steel ball respectively mounted in two opposite ends of one of said through holes of said socket, and a spring arranged between said outer steel ball and said inner steel ball;

a clamp mounted around said outside annular groove of said socket and having two arched portions respectively curving outwards, said clamp being movable within said outside annular groove of said socket between a first position and a second position where one end thereof abuts a respective said spring pin for permitting one of said arched portions to be forced into alignment with one of said through holes of said socket so that one locating device is forced from said non-operative position into said operative position and said other locating device is released from said operative position and returned to said non-operative position; and a handle adapted for turning said socket, said handle comprising a circular driving rod perpendicularly disposed at one end and adapted for inserting into said socket, and a plurality of rounded recesses spaced around said periphery and adapted for receiving one said inner steel ball;

wherein each of said through holes of said socket has an inner end defining first and second contact portions arranged on opposed inner surfaces to an edge of a respective through hole, said first contact portion having an axial length that is longer than a radius of said inner steel balls, and said second contact portion has an axial length that is shorter than said radius of said inner steel balls; said axial lengths extending along a longitudinal axis of a respective through hole said inner steel ball is disengaged from said driving rod of said handle when forced into contact with said second contact portion of said respective through hole and when said respective locating device is forced into said operative position and said driving rod of said handle is turned in one direction, thereby causing said driving rod of said handle to run idle; said inner steel ball is forced into engagement with said driving rod of said handle when it is forced into contact with said first contact portion of said respective through hole and when said respective locating device is forced into said operative position and said driving rod of said handle is turned in said reversed direction, thereby causing said socket to be turned with said driving rod of said handle.

2. The reversible socket wrench of claim 1, wherein said handle comprises a square coupling rod perpendicularly disposed at one end and adapted for holding said driving rod, and a split clamping ring adapted for securing said driving rod to said square coupling rod, said driving rod having a square axial hole which receives said square coupling rod of said handle, and an outside annular groove around said periphery near one end on which said split clamping ring is mounted.

3. A reversible socket wrench comprising:

a socket having an outside annular groove, two radial locating holes in said outside annular groove, and two radial through holes respectively disposed opposite to said radial locating holes;

two spring pins respectively mounted in said radial locating holes of said socket and disposed in flush with a periphery of said socket;

two locating devices respectively mounted in said radial through holes of said socket and alternatively movable between an operative position and a non-operative position, each of said locating devices including a steel ball and a toothed member respectively mounted in two opposite ends of one of said radial through holes of said socket, and a spring arranged between said steel ball and said toothed member, said toothed member comprising a toothed oval body disposed inside said socket outside said corresponding radial through hole, and a rod raised from said toothed oval body and inserted into said corresponding radial through hole and coupled to said spring;

a clamp mounted around said outside annular groove of said socket, having two arched portions respectively curving outwards, said clamp being movable within said outside annular groove of said socket between a first position and a second position so that one end thereof abuts against a respective said spring pin for permitting one of said arched portions to be forced into alignment with one of said radial through holes of said socket so that one locating device is forced from said non-operative position into said operative position and said other locating device is released from the operative position and returned to said non-operative position; and a handle adapted for turning said socket, said handle comprising a circular driving rod perpendicularly disposed at one end and adapted for inserting into said socket, and a toothed portion around said periphery adapted for engaging said toothed body of one said toothed members;

wherein when one locating device is forced into said operative position and said driving rod of said handle is turned in one direction, said toothed body of said respective toothed member is forced into engagement with said toothed portion of said driving rod of said handle, permitting said socket to be turned with said driving rod of said handle, and said toothed body of said respective toothed member is disengaged from said toothed portion of said driving rod of said handle when said driving rod of said handle is turned in said reversed direction, thereby causing said driving rod of said handle to run idle.

* * * * *